US007124906B2

(12) United States Patent
Hamer et al.

(10) Patent No.: US 7,124,906 B2
(45) Date of Patent: Oct. 24, 2006

(54) APPARATUS AND METHOD FOR PROTECTING FLOATING ROOF TANKS FROM THE EFFECTS OF LIGHTNING STRIKES

(75) Inventors: Paul Hamer, San Ramon, CA (US); William J. Johnston, Concord, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 45 days.

(21) Appl. No.: 10/705,547

(22) Filed: Nov. 10, 2003

(65) Prior Publication Data

US 2005/0098560 A1 May 12, 2005

(51) Int. Cl.
*B65D 88/46* (2006.01)

(52) U.S. Cl. ..... 220/224; 220/216

(58) Field of Classification Search ..... 220/216–227
See application file for complete search history.

(56) References Cited

U.S. PATENT DOCUMENTS

| | | | | | |
|---|---|---|---|---|---|
| 1,930,953 | A | * | 10/1933 | Hampton | 220/224 |
| 2,651,433 | A | * | 9/1953 | Mjellem | 220/222 |
| 2,888,161 | A | * | 5/1959 | Springer | 220/224 |
| 2,914,212 | A | | 11/1959 | Fino | |
| 2,981,438 | A | | 4/1961 | Heisterberg | |
| 3,106,309 | A | | 10/1963 | Nelson et al. | |
| 3,135,415 | A | | 6/1964 | Fino | |
| 3,167,206 | A | | 1/1965 | Nelson | |
| 3,261,496 | A | * | 7/1966 | Joor, II | 220/225 |
| 3,373,891 | A | | 3/1968 | Kidd | |
| 3,398,851 | A | | 8/1968 | Challenger et al. | |
| 3,453,493 | A | * | 7/1969 | Godwin, Jr. | 361/215 |
| 3,589,549 | A | * | 6/1971 | Heisterberg | 220/222 |
| 3,942,674 | A | * | 3/1976 | Nelson | 220/221 |
| 4,130,217 | A | | 12/1978 | Hills et al. | |
| 4,203,090 | A | | 5/1980 | Adamson | |
| 4,273,250 | A | | 6/1981 | Kinghorn, Sr. et al. | |
| 4,371,090 | A | | 2/1983 | Ogarek et al. | |
| 4,540,104 | A | * | 9/1985 | Kawai et al. | 220/224 |
| 4,613,922 | A | | 9/1986 | Bachmann | |
| 5,078,293 | A | * | 1/1992 | Lippiello | 220/221 |
| 5,103,992 | A | | 4/1992 | Lippiello et al. | |
| 5,301,828 | A | | 4/1994 | McKay | |
| 5,316,641 | A | | 5/1994 | Wright et al. | |
| 5,321,881 | A | | 6/1994 | Lippiello et al. | |
| 5,330,009 | A | | 7/1994 | Zhang | |
| 5,372,270 | A | | 12/1994 | Rosenkrantz | |
| 5,423,446 | A | | 6/1995 | Johnson | |
| 5,529,200 | A | | 6/1996 | Ford et al. | |
| 5,667,091 | A | | 9/1997 | Slaber, Jr. et al. | |
| 6,354,488 | B1 | | 3/2002 | Gallagher | |

* cited by examiner

*Primary Examiner*—Lien M. Ngo
(74) *Attorney, Agent, or Firm*—Steven H. Roth

(57) ABSTRACT

An apparatus and method for protecting a floating roof tank from the effects of a lightning strike are disclosed. In one aspect, the apparatus comprises an electrically conductive bonding strap in electrical communication with an inner tank wall and the floating roof located below liquid level, the bonding strap being of a length to minimize its self inductance, so as to provide a preferred electrically efficient path for conduction of lightning stroke current through an oxygen deficient environment.

21 Claims, 1 Drawing Sheet

APPARATUS AND METHOD FOR PROTECTING FLOATING ROOF TANKS FROM THE EFFECTS OF LIGHTNING STRIKES

FIELD OF THE INVENTION

The present invention relates generally to liquid storage tanks having roofs that float on the surface of the stored liquid and particularly to an apparatus and method for protecting storage tanks having floating roofs from the effects, of lightning strikes.

BACKGROUND OF THE INVENTION

Lightning strikes that hit equipment and storage or process vessels containing flammable materials can cause devastating incidents at refineries, bulk plants, processing sites and other facilities. In recent years, several incidents have occurred where lightning has struck facilities storing or handling flammable substances, which resulted in explosions and fires. Substantial monetary loss due to damage to the facility and loss of product and significant environmental damage may occur as a result of the effects of a lightning strike.

Floating roof tanks are widely used to store volatile petroleum-based liquids and limit the quantity of product evaporative emissions that may escape to the environment. Such tanks may be configured either as internal floating-roof tanks or as external floating-roof tanks. In each configuration, the floating-roof is designed to remain in contact with the product liquid surface and cover almost the entire surface of the product. A small annular area between the outermost rim of the floating roof and the inside surface of the tank shell is covered by a seal attached to the rim of the floating roof. There are many types of seals available for the annular space and are selected based on the owner's preference, the type of product, and emissions reduction requirements. In many cases today, tanks have two seals, one of which is used to reduce the emissions from the tank to very low levels.

Seals for floating roofs within storage tanks can assume a variety of different configurations. One such arrangement is shown in U.S. Pat. No. 4,308,968. That arrangement includes two different seals, the first being a primary seal and the second being a backup or secondary seal. This sealing arrangement utilizes vapor barriers in combination with flexible metal plates and wiper blades. The vapor barriers, which are common in many floating roof seals, comprise one or more layers of fabric which are generally impermeable to vapors from the liquid product stored in the tank.

One type of floating roof seal which has been found to be quite effective is the shoe seal. Shoe seals employ a shoe in the form of a series of joined-together plates which are disposed against the inner wall of the tank and which are supported by the outer rim of the floating roof. A vapor barrier extending between the outer rim and the shoe provides an effective barrier to vapors from the liquid product in the tank, inasmuch as the lower portion of the shoe extends into the product.

Examples of shoe seals are provided by U.S. Pat. No. 2,981,438; U.S. Pat. No. 3,167,206; and U.S. Pat. No. 4,130,217. In U.S. Pat. No. 2,981,438, the sealing mechanism is provided with a combination weatherhood and wax-trough. The shoe is forced against the inner tank wall by spring-loaded pistons mounted within the outer rim of the floating roof. In U.S. Pat. No. 3,167,206, the shoe is suspended from the outer rim of the floating roof by a pivoting hanger structure designed to force the shoe against the inner tank wall. In U.S. Pat. No. 4,130,217, various different members including springs are employed to maintain the shoe against the inner tank wall.

Sometimes, these sealing systems have, as an option, included a shunt located above the seals to provide an electrical path for static or lightning induced electricity from the floating roof to the tank wall so that any arcing resulting from the flow of electricity occurs near the shunt and away from the potentially ignitable vapors stored below the seals. Such a system is disclosed in U.S. Pat. Nos. 5,529,200 and 5,667,091, which are incorporated by reference herein. Another system that is similarly configured is disclosed in U.S. Pat. No. 4,371,090.

The following are excerpts from the current Chapter 6 of NFPA 780-2000, Standard for the Installation of Lightning Protection Systems, on floating roof tanks. These excerpts demonstrate the need for the improved method and apparatus of the present invention.

"6.4.1.2 Floating Roof Tanks (a) General. Fires have occurred when lightning has struck the rims of open-top floating roof tanks where the roofs were quite high and the contents volatile. Similar above-the-seal fires have occurred when direct lightning strokes to the rims of floating roof tanks have ignited flammable vapors within the open shells. These have occurred where roofs Were low. The resulting seal fires have been at small leakage points in the seal. An effective defense against ignition by a direct stroke is a tight seal.

Fires have also occurred in the seal space of open-top floating roof tanks as a result of discharges caused by lightning. These have occurred most frequently in tanks having floating roofs and seals with vapor spaces below the flexible membranes. Similar vapor spaces will be formed where tanks are fitted with secondary seals in compliance with environmental regulations. Ignition can be from a direct stroke or from the sudden discharge of an induced (bound) charge on the floating roof, released when the charge on a cloud discharges to ground or to another cloud.

(b) Protection. Where floating roofs utilize hangers located within a vapor space, the roof shall be electrically bonded to the shoes of the seal through the most direct electrical path at intervals not greater than 10 ft (3 m) on the circumference of the tank. These shunts shall consist of flexible Type 302, 28-gauge [1/64 in.×2 in. (0.4 mm×51 mm)] wide stainless steel straps or the equivalent in current-carrying capacity and corrosion resistance. The metallic shoe shall be maintained in contact with the shell and without openings (such as corrosion holes) through the shoe. Tanks without a vapor space at the seal shall not require shunts at the seal. Where metallic weather shields cover the seal, they shall maintain contact with the shell.

Where a floating roof is equipped with both primary and secondary seals, the space between the two seals could contain a vapor-air mixture within the flammable range; therefore, if the design of such a seal system incorporates electrically conductive materials and a spark gap exists within that space or could be created by roof movement, shunts shall be installed so that they directly contact the tank shell above the secondary seal. The shunts shall be spaced at intervals not greater than 10 ft (3 m) and shall be constructed so that metallic contact is maintained between the floating roof and the tank shell in all operational positions of the floating roof."

It has been found that the shunts and shoes used in present installations do not adequately protect the floating roof storage tanks from the effects of a lightning strike. It was assumed that they had sufficient contact to the outer tank wall for conducting such a discharge; however, it has been found in some cases that the measured resistance between the shoe and outer tank wall was in the order of millions of ohms. This high resistance connection point would cause an ignition source or arcing that could ignite the flammable vapors in the primary seal, or at the secondary seal along the rim of the floating roof. American Petroleum Institute's collection of 44 years of member company data reveals 65 large aboveground storage tank fires caused by lightning, 61% of the cases evaluated (API Publication 2021A, Interim Study-Prevention and Suppression of Fires in Large Aboveground Atmospheric Storage Tanks, July 1998).

NFPA 77-2000 (Recommended Practice on Static Electricity) states that bonding of equipment or parts with less than one megohm in resistance should be sufficient to dissipate the small charges that would occur from static sources. Conductive bonding for static discharge is typically less than 10 ohms resistance. However, a lightning stroke discharge current is orders of magnitude larger that a static electricity discharge and requires a much lower bonding resistance. API RP 2003–1998 (Protection Against Ignitions Arising Out of Static, Lightning, and Stray Currents) suggests that for lightning, the bonding resistance needs to be significantly lower, no more than a few ohms. NFPA 780-2000 (Standard for the Installation of Lightning Protection Systems) requires bonding conductors be sized to be a minimum of 26,240 circular-mil cross-section copper—much less than one ohm resistance for a typically short bonding distance.

Among other factors, the present invention is based on our discovery that removing the shunts above the seals would prevent the arcing from occurring and thus prevent a rim fire. Additionally, by adding a corrosion resistant bonding strap and welding or bolting this strap to the bottom of the shoe assembly below the product level and to the lower portion of the floating roof pontoon assembly also below the product level would provide the most direct electrical path to earth for the lightning stroke current to flow and would be in an environment that is the most oxygen deficient. The use of the submerged bonding strap or shunt of the present invention would eliminate the currently used "above the seal" bonding strap and protect the tank and its combustible contents. This type of submerged bond would have less than one ohm resistance, and if any arcing occurred, it would be in a total liquid phase with no oxygen to support combustion. Furthermore, the lightning secondary effects (e.g., the induced "bound" charge as described in NFPA 780-2000) would be minimized as an added benefit.

SUMMARY OF THE INVENTION

The present invention provides a method of protecting a floating roof tank from the effects of a lightning strike comprising the step of placing an electrically conductive bonding strap at one end into electrical contact with an inner wall of the tank below liquid level in the tank and connecting a second end of the bonding strap to the floating roof below liquid level, the bonding strap being of a length to minimize its self inductance, so as to provide a preferred electrically efficient path for conducting electrical current through an oxygen deficient environment.

The present invention also provides an improvement In a liquid storage tank having an inner tank wall and a floating roof, the improvement which comprises means for establishing electrical communication between the inner tank wall and the floating roof, said means being located below the liquid level and being configured to have minimum self inductance, so as to provide a preferred path for dissipating electrical current through an oxygen deficient environment in the storage tank.

DETAILED DESCRIPTION OF THE DRAWINGS

Figure 1:
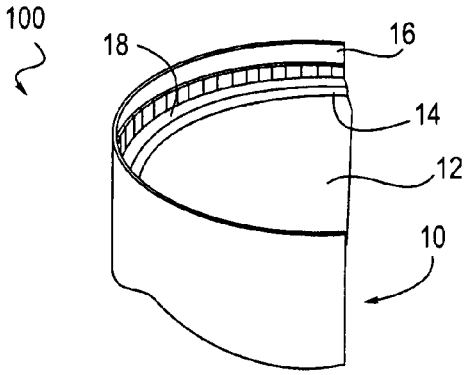
FIG. 1 is a perspective view of a portion of an oil storage tank having a floating roof and a seal between the outer rim of the floating roof and the inner tank wall.

FIG. 1 depicts a storage tank 10 having a floating roof 12 disposed therein. The floating roof 12 floats on top of a liquid product such as oil or other hydrocarbon products stored within the tank 10.

To prevent hydrocarbon vapors from escaping into the atmosphere from the space between an outer rim 14 of the floating roof 12 and an inner tank wall 16, a seal 18 is provided. The seal 18 extends between the outer rim 14 of the floating roof and the inner tank wall 16 around the circumference of the floating roof 12, and acts as a barrier to hydrocarbon vapors. The seal 18 must be capable of movement up and down the inner tank wall 16 while maintaining a sealing relationship therewith, so that the floating roof 12 may rise or fall with varying quantities of liquid product stored in the tank 10.

The seal 18 may be of the shoe type in which a series of plates joined together and extending around the circumference of the floating roof 12 form a shoe which is mounted on the outer rim 14 of the floating roof 12. As described hereafter, shoe seals scissors hanger assemblies for hanging the shoe on the outer rim 14 in combination with resilient elements which force the shoe outwardly from the outer rim 14 of the floating roof 12 and into engagement with the inner tank wall 16.

Figure 2:
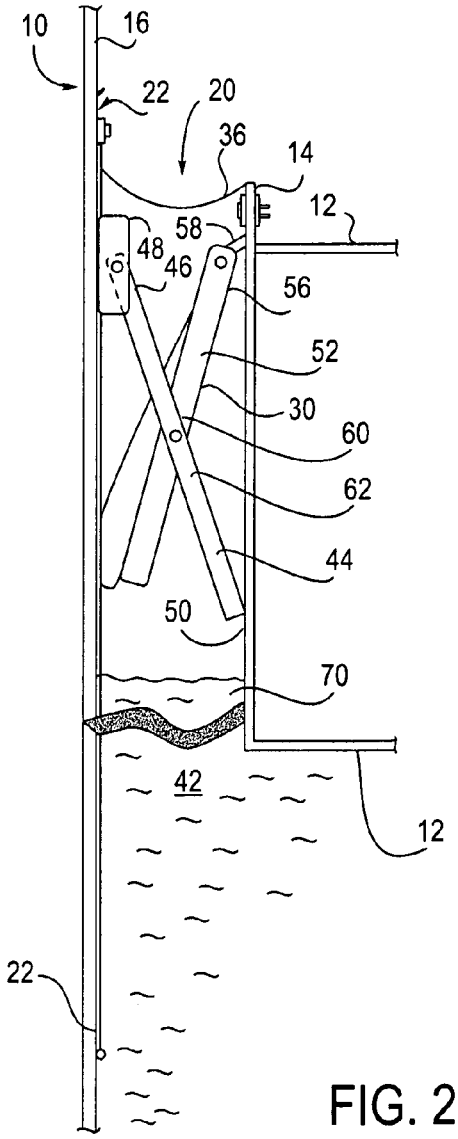
FIG. 2 is a side view of a shoe seal according to one embodiment of the present invention.

FIG. 2 depicts an embodiment of a shoe seal 20 that may be used in accordance with the present invention. FIG. 2 depicts a portion of the storage tank 10 of FIG. 1 including the inner tank wall 16 and a portion of the floating roof 12 including the outer rim 14. The roof 12 floats on oil or other liquid product 42 stored within the tank 10.

The shoe seal 20 includes a shoe 22 comprised of a series of metal plates. In addition to the shoe 22, the shoe seal 20 includes a plurality of scissors hanger assemblies 30 which mount the shoe 22 on the outer rim 14 in a manner permitting a substantial amount of movement of the shoe 22 relative to the outer rim 14. This permits the shoe 22 to be maintained in contact with the inner tank wall 16 in the presence of varying space between the outer rim 14 and the inner tank wall 16 about the circumference of the floating roof 12 and irregularities in the surface of the inner tank wall 16. The scissors hanger assemblies 30 are mounted in spaced apart fashion along the shoe 22. The scissors hanger assemblies 30 are coupled to the shoe 22 by bolting and are mounted on the outer rim 14 of the floating roof 12 by bolting.

FIG. 2 is a side view of the shoe seal 20 which shows a liquid product 42 within the tank 10. The liquid product 42 supports the floating roof 12. As shown in FIG. 2, the scissors hanger assembly 30 includes an elongated plate 44 having an upper end 46 pivotally coupled to a shoe clip 48. The shoe clip 48 is bolted to the shoe 22. The elongated plate 44 extends downwardly and outwardly from the shoe clip 48 and the shoe 22 and terminates at a lower end 50 thereof which contacts the floating roof 12. The scissors hanger assembly 30 also includes a pair of elongated bars 52 which are pivotally coupled at upper ends 56 thereof to a rim clip 58. The rim clip 58 is bolted to the outer rim 14 of the floating roof. The elongated bars 52 extend downwardly and outwardly from the rim clip 58 and the floating roof 12. Only the elongated bar 52 is seen in FIG. 2, inasmuch as the opposite elongated bar 54 is disposed there behind on the other side of the elongated plate 44 therefrom. The elongated bars 52 and have intermediate portions 60 which are pivotally coupled to an intermediate portion 62 of the elongated plate 44. A vapor barrier 36 is mounted so as to extend between the shoe 22 and the outer rim 14. Such vapor barrier 36 is provided by a length of vapor impermeable fabric.

The scissors hanger assemblies 30 mount or hang the shoe 22 on the floating roof 12 in a manner which permits considerable lateral movement of the shoe 22 relative to the floating roof 12. This enables the shoe seal 20 to accommodate substantial variations in the space between the inner tank wall 16 and the floating roof 12 around the circumference of the floating roof 12.

As shown in FIG. 2, the shoe 22 extends down into the liquid product 42. This is one of the features of shoe seals which make them effective. The vapor barrier 36 seals the space between the shoe 22 and the outer rim 14 of the floating roof 12, while at the same time flexing as necessary to permit lateral movement of the shoe 22 relative to the floating roof 12. Because the lower end of the shoe 22 is immersed in the liquid product 42, vapors from the liquid product 42 within the space between the shoe 22 and the floating roof 12 are trapped by the vapor barrier 36. The shoe 22 is normally in contact with the inner tank wall 16 so that no vapors from the liquid product 42 can pass there between. However, in instances where the shoe 22 pulls away from the inner tank wall 16 to form a small space there between, vapors from the liquid product 42 escaping through the small space are negligible. A shoe seal of this kind is described in greater detail in U.S. Pat. Nos. 5,103,992 and 5,667,091, which are incorporated by reference herein.

Sometimes, shoe seals have as an option included a shunt located above the seals to provide an electrical path for static or lightning-induced electricity from the floating roof to the tank wall so that any arcing resulting from the flow of electricity occurs near the shunt and away from the potentially ignitable vapors stored below the seals. Such systems are disclosed in U.S. Pat. Nos. 5,529,200 and 5,667,091. With reference to FIG. 2, a shunt, not shown, in resilient contact with the inner tank wall 16 would be installed above the vapor barrier 36 by attachment to an upper end of the floating roof 12 above the product level to provide an electrical path for static or lightning induced electricity from the floating roof 12 to the inner tank wall 16. This is shown in FIG. 2 of U.S. Pat. No. 5,667,091.

Further with reference to FIG. 2, bonding strap (or shunt) 70 is mounted so as to extend between a lower end of shoe 22 and a lower end of floating roof 12 to establish electrical communication there between below the level of liquid product 42 stored in the tank 10. Bonding strap 70 could be connected by bolting, welding, clipping or other methods known to the skilled artisan. The bonding strap 70 is immersed in the liquid stored in the tank, for example, by being connected at the bottom of the shoe and tank roof pontoon assembly to provide the preferred path for lightning stroke current in the most oxygen-deficient zone of the scissor and shoe assembly. Consequently, there would no longer be a need for the presently used "above the seal" bonding strap or shunt.

Bonding strap 70 may be made of any electrically conductive material such as stainless steel, copper, tinned-copper, or bronze (formed as a flexible braid or as a flexible, ribbon-shaped strap). The material for the bonding strap is preferably corrosion resistant. Stainless steel is preferred. What we have termed a bonding strap is sometimes referred to as a grounding strap or a shunt. The present invention contemplates the use of any means to provide a path for electrical communication between the inner tank wall 16 and the floating roof 12, and any technique used to minimize its electrical self inductance or to reduce its electrical high-frequency resistance to lightning surge currents.

The dimensional characteristics of bonding strap 70 are an important consideration in providing protection against the effect of lightning strikes, which produce current of up to 200,000 amperes. As such, the bonding strap 70 should be sized to be of a length to minimize its self inductance, i.e., it should be no longer than necessary to bridge the gap between the shoe and the floating roof considering the practical necessity for it to adapt to shell irregularities. In the context of the shoe assembly exemplified herein, the length of the strap would be as required to permit the "scissor" spring assembly to be bridged and to allow for normal travel of the scissor-spring assembly centering function. This adaptation would lengthen the bonding strap 70 by no more than the allowed seal tolerances (typically 4 inches). An adaptation is also considered that keeps the bonding strap taut by use of an integral or external spring mechanism. The width of the strap gives the strap a large surface area and minimizes the self inductance and high-frequency resistance of the strap connection, and this is more important for carrying lightning surge current with minimum rise in voltage across the strap. This feature, combined with the many parallel paths across the numerous scissor assemblies, would minimize sparking and if sparking should occur, it will be in a very "rich" oxygen-deficient zone.

The bonding strap 70 should also be configured for good physical durability. The cross-sectional area would typically be at least 0.031 square inches to conform to NFPA 780 requirements. It should preferably be at least 1 inch wide to keep the strap's self inductance high-frequency resistance to a reasonably low value. One preferred example would be to use a standard 1-inch wide braided strap which would be approximately 4 AWG (American Wire Gauge) size. This is far larger in cross-section than required in the NFPA 780 requirements for the present "above the seal" bonding shunt.

The bonding straps 70 are located at any desired interval around the circumference of the tank and are preferably located at intervals of 10 feet around the circumference of the tank to conform to current NFPA requirements. This interval could be adjusted to be in conformance with future NFPA standard requirements or recommendations.

There is no requirement for tank grounding or earthing, because what is more important for lightning protection is proper bonding of metallic parts to eliminate or minimize arcing. The ANSI consensus standard on the subject, NFPA 780-2000 (Standard for the Installation of Lightning Protection Systems), only requires one of the following for tank grounding:

1) Connection, without insulating joints, to a grounded metallic piping system.
2) Vertical cylindrical tanks 6 m (20 ft), or greater, in diameter be resting on concrete or earth, or tanks 15 m (50 ft), or greater, in diameter be resting on bituminous pavement.
3) Tanks be bonded to ground by at least two 2.4 m (8 ft) long ground rods, or other acceptable ground terminals, at maximum 30 m (100 ft) intervals along the perimeter of the tank.

Modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which are within the scope of the appended claims is reserved.

What is claimed is:

1. In an apparatus for sealing the space between a floating roof and a tank wall in a liquid storage tank which includes means for mounting a shoe assembly on the floating roof in the storage tank and maintaining the shoe in contact with an inner wall of the tank, the improvement which comprises an electrically conductive bonding strap connected at one end to a lower portion of the shoe assembly below liquid level and at a point where the shoe assembly contacts the inner wall and connected at a second end to the floating roof below liquid level, the bonding strap being of a length to minimize its self inductance, wherein the bonding strap is entirely below liquid level so as to provide a preferred path for dissipating electrical current through an oxygen deficient environment.

2. The apparatus of claim 1, wherein the bonding strap is made of a material selected from the group consisting of stainless steel, copper, tinned-copper, bronze and mixtures thereof.

3. The apparatus of claim 1, wherein the liquid storage tank is an external floating roof tank.

4. The apparatus of claim 1, wherein the bonding strap is no longer than required to bridge the distance between the floating roof and the shoe assembly at locations the bonding strap is connected there between, allowing for seal tolerances.

5. The apparatus of claim 1, wherein the bonding strap is made of a corrosion resistant material.

6. A method of protecting a floating roof tank from the effects of a lightning strike comprising the steps of placing an electrically conductive bonding strap at one end into electrical contact with an inner wall of the tank through a sliding shoe seal assembly at a point where the shoe assembly contacts the inner wall below liquid level in the tank and connecting a second end of the bonding strap to the floating roof below liquid level, the bonding strap being of a length to minimize its self inductance, wherein the bonding strap is entirely below liquid level so as to provide a preferred electrically efficient path for conducting electrical current through an oxygen deficient environment.

7. The method of claim 6, wherein the bonding strap is made of a material selected from the group consisting of stainless steel, copper, tinned-copper, bronze and mixtures thereof.

8. The method of claim 6, wherein the bonding strap is no longer than the allowed seal tolerances between the floating roof and the shoe assembly at locations the bonding strap is connected there between.

9. The method of claim 6, wherein the bonding strap is made of a corrosion resistant material.

10. In an apparatus for sealing the space between a floating roof and an inner tank wall in a liquid storage tank, the improvement which comprises means for establishing electrical communication between the inner tank wall and the floating roof located entirely below liquid level, said means being of a length to minimize its self inductance, so as to provide a preferred path for dissipating electrical current through an oxygen deficient environment.

11. In a liquid storage tank having an inner tank wall and a floating roof, the improvement which comprises means for establishing electrical communication between the inner tank wall and the floating roof, said means being located entirely below the liquid level and being configured to have minimum self inductance, so as to provide a preferred path for dissipating electrical current through an oxygen deficient environment in the storage tank.

12. A method of protecting a floating roof tank from the effects of a lightning strike comprising the steps of providing means for establishing electrical communication between inner tank wall and the floating roof whereby said means is located entirely below liquid level, said means being of a length to minimize its self inductance, so as to provide a preferred electrically efficient path for conduction of lightning stroke current through an oxygen deficient environment.

13. An apparatus according to claim 10, wherein the means for establishing electrical communication is an electrically conductive bonding strap.

14. An apparatus according to claim 13, wherein the bonding strap is made of a material selected from the group consisting of stainless steel, copper, tinned copper, bronze and mixtures thereof.

15. An apparatus according to claim 14, wherein the bonding strap is formed as a flexible ribbon-shaped strap or as a flexible braid.

16. An apparatus according to claim 11, wherein the means for establishing electrical communication is an electrically conductive bonding strap.

17. An apparatus according to claim 16, wherein the bonding strap is made of a material selected from the group consisting of stainless steel, copper, tinned copper, bronze and mixtures thereof.

18. An apparatus according to claim 17, wherein the bonding strap is formed as a flexible ribbon-shaped strap or as a flexible braid.

19. An apparatus according to claim 12, wherein the means for establishing electrical communication is an electrically conductive bonding strap.

20. An apparatus according to claim 19, wherein the bonding strap is made of a material selected from the group consisting of stainless steel, copper, tinned copper, bronze and mixtures thereof.

21. An apparatus according to claim 20, wherein the bonding strap is formed as a flexible ribbon-shaped strap or as a flexible braid.

* * * * *